US006529099B1

(12) United States Patent
Takenaka

(10) Patent No.: US 6,529,099 B1
(45) Date of Patent: Mar. 4, 2003

(54) 180° PHASE SHIFT CIRCUIT HAVING AN IMPROVED ISOLATION CHARACTERISTIC

(75) Inventor: Isao Takenaka, Tokyo (JP)

(73) Assignee: NEC Compound Semiconductor Devices, Ltd., Kawasaki (JP)

( * ) Notice: Subject to any disclaimer, the term of this patent is extended or adjusted under 35 U.S.C. 154(b) by 0 days.

(21) Appl. No.: 09/621,340

(22) Filed: Jul. 21, 2000

(30) Foreign Application Priority Data

Jul. 23, 1999 (JP) ..... 11-208795

(51) Int. Cl.[7] ..... H01P 9/00
(52) U.S. Cl. ..... 333/156; 333/26
(58) Field of Search ..... 333/156, 26, 124, 333/125, 33, 35, 32, 25; 330/124 R, 295

(56) References Cited

U.S. PATENT DOCUMENTS 5,416,451 A 5/1995 Kaltenecker et al. ..... 333/25
5,467,063 A * 11/1995 Burns et al. ..... 333/125
5,684,430 A * 11/1997 Yamamoto ..... 330/124 R
5,809,409 A * 9/1998 Itoh et al. ..... 455/327
6,128,479 A * 10/2000 Fitspatrick et al. ..... 455/137

FOREIGN PATENT DOCUMENTS

JP 7-131277 5/1995
JP 2000-4109 1/2000

OTHER PUBLICATIONS

Gordon J. Laughlin, "A New Impedance–Matched Wide–Band Balun and Magic Tee.", IEEE Transactions on Microwave Theory and Techniques, vol. MTT–24, No. 3, pp. 135141, Mar. 1976.

* cited by examiner

*Primary Examiner*—Robert Pascal
*Assistant Examiner*—Joseph Chang
(74) *Attorney, Agent, or Firm*—Foley & Lardner

(57) ABSTRACT

A 180° phase shift circuit includes a balun having an unbalanced port and a pair of balanced ports, a pair of impedance matching lines each connected between one of the pair of balanced ports and one of a pair of balanced signal terminals, and a λg/2 distributed parameter line having ends each connected via a resistor to a node connecting together corresponding impedance matching line and corresponding balanced signal terminal. The resistor has a resistance equal to ⅔ of the characteristic impedance of the impedance matching lines

6 Claims, 12 Drawing Sheets

180° PHASE SHIFT CIRCUIT HAVING AN IMPROVED ISOLATION CHARACTERISTIC

BACKGROUND OF THE INVENTION (a) Field of the Invention

The present invention relates to a 180° phase shift circuit having an improved isolation characteristic and, more particularly, to a 180° phase shift circuit having an improved isolation characteristic as well as phase shift characteristics.

(b) Description of the Related Art

A 180° phase shift circuit is a balance-unbalance converter which converts an unbalanced signal, input between an unbalance terminal and the ground, into a pair of balanced signals having an equal amplitude and a phase difference of 180° therebetween by using a power distribution, and thus delivers the pair of balanced signals through a pair of balanced signal output terminals. The principal part of the 180° phase shift circuit is called "balun" in this technical field In the field of microwave circuits, 180° phase shift circuits are widely used as a power distribution/synthesis circuit for a power amplifier, a balanced modem circuit, a mixer, and a phase shift device. A variety of proposals have been made for improving the characteristics of the 180° phase shift circuit.

Patent Publication JP-A-7-131277 describes a 180° phase shift circuit, such as shown in FIG. 1, which compensates degradations in an amplitude-difference characteristic and a phase-difference characteristic between the pair of balanced signals FIG. 1 shows an example of the 180° phase shift circuit used for an amplifier block, wherein the 180° phase shift circuits 51A and 51B are used as an input circuit and an output circuit, respectively, for the amplifier block 43 having a pair of balanced signal input terminals T21 and T31 and a pair of balanced signal output terminals T22 and T32.

Each of the 180° phase shift circuits 51A and 51B is connected at the pair of balanced signal terminals T21 and T31 or T22 and T32 to the terminals of the amplifier block 43 after an impedance matching of the 180° phase shift circuits 51 with the amplifier block 43. Thus, the amplifier block 43 receives input balanced signals from the 180° phase shift circuit 51A to deliver output balanced signals to the 180° phase shift circuit 51B. In this configuration, the 180° phase shift circuit 51B delivers an output unbalanced signal having a reduced distortion within a wide band, which improves the characteristics of the amplifying system as a whole including the amplifier block 43 and the pair of 180° phase shift circuits 51A and 51B.

Each of the 180° phase shift circuits 51A and 51B includes a balun 41 and an amplitude/phase correction circuit 42. The balun 41 in the 180° phase shift circuit 51A converts the unbalanced signal supplied through an input port P1 to deliver a pair of balanced signals through the output ports P2 and P3. The balun 41 in the 180° phase shift circuit 51B converts balanced signals supplied through the input ports P2 and P3 to deliver an unbalanced signal through an output port P1 thereof. The amplitude/phase correction circuit 42, connected between the output port P2 and balanced signal output terminal T21, is implemented by a distributed parameter line having a specific characteristic impedance and a specific length for compensating or correcting the characteristics of the 180° phase shift circuit for the amplitude difference and the phase difference between both the balanced signal.

In the 180° phase shift circuit, if a reflected wave is generated due to an impedance mismatching on one of the pair of balanced signal terminals, the reflected wave is transferred though the 180° phase shift circuit to the other of the pair of balanced signal terminals as a leakage signal. The leakage signal generates an adverse effect on the function of the circuitry unless the 180° phase shift circuit has an excellent isolation characteristic. In the described circuitry, however, the isolation characteristic is not considered on the premise that a sufficient impedance matching is attained in the circuitry.

SUMMARY OF THE INVENTION

It is therefore an object of the present invention to provide a 180° phase shift circuit having improved phase shift characteristics and an improved isolation characteristic.

The present invention provides a 180° phase shift circuit including a first through third signal terminals, a balun including first and second ports for receiving/delivering a pair of balanced signals and a third port for delivering/receiving an unbalanced signal, a first impedance matching line connected between the first port and the first signal terminal, a second impedance matching line connected between the second port and the second signal terminal, and a serial branch including first and second resistors and a $\lambda g/2$ distribution parameter line connected between the fist resistor and a second resistor, the serial branch being connected between a first node connecting together the first impedance matching line and the first signal terminal and a second node connecting together the second impedance matching line and the second signal terminal.

In accordance with the 180° phase shift circuit of the present invention, reflected signal generated outside the 180° phase shift circuit due to impedance-mismatching and entering the 180° phase shift circuit through one of the balanced signal terminals cannot pass through the other of the balanced signal terminals. Thus, the isolation characteristic of the 180° phase shift circuit can be improved without degrading the phase shift characteristics of the 180° phase shift circuit.

The above and other objects, features and advantages of the present invention will be more apparent from the following description, referring to the accompanying drawings.

PREFERRED EMBODIMENT OF THE INVENTION

Figure 1:
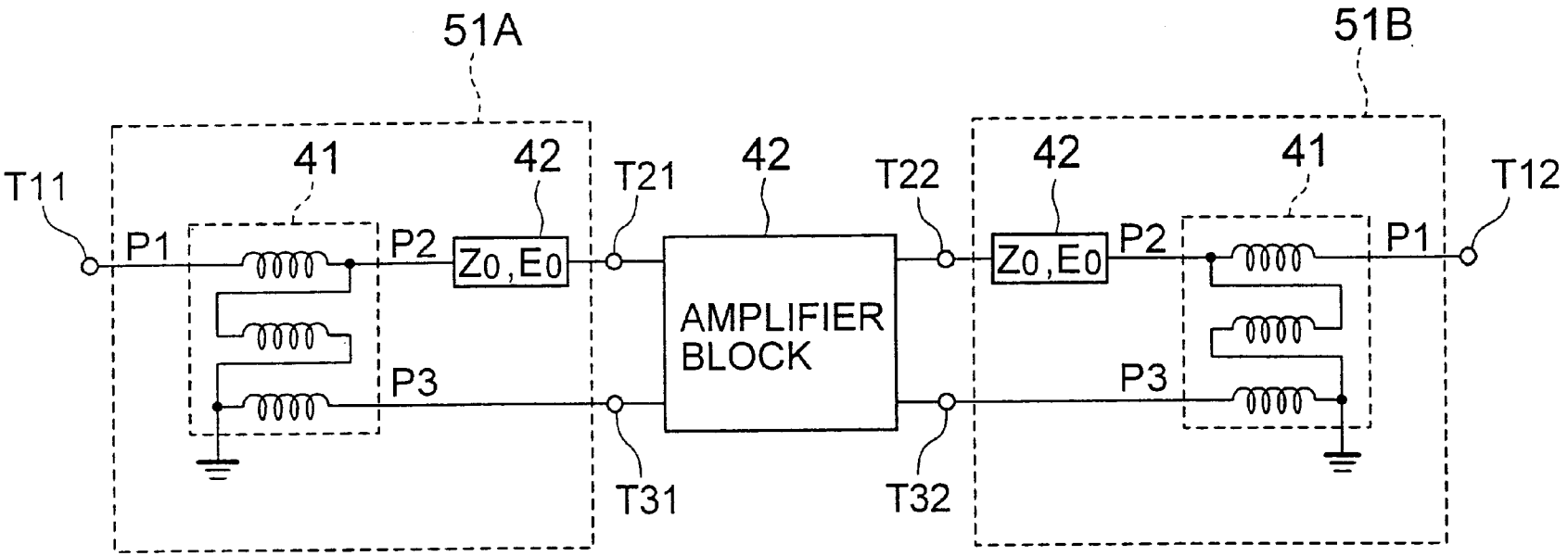
FIG. 1 PRIOR ART
FIG. 1 is a circuit diagram of a conventional 180° phase shift circuit.

Before describing embodiments of the present invention, the configuration of a known merchant balun in a 180° phase shift circuit will be described below. Among other known baluns, the merchant balun has the advantages of a smaller size and a wider-band frequency response, and thus is used in the field of microwave ranges. "A New Impedance-Matched Wide-Band Balun and Magic Tee" in IEEE Trans. Microwave Theory Tech., vol. MTT-24, No. 3, March 1976, describes the merchant balun shown in FIG. 2.

The merchant balun 10 includes a first line section 101, a second line section 102 and a third line section 103, each including a pair of λg/4 (¼-wavelength) coupling lines 11 and 12, or 13 and 14, or 15 and 16. Each λg/4 coupling line has an electrical length of ⅜ wavelength of the input signal.

More specifically, the first line section 101 includes an open-end coupling line 11 having an open distal end and an unbalanced coupling line 12 having an unbalanced proximal port connected to an unbalanced signal terminal T1. The distal end of the unbalanced coupling line 12 is connected to the open-end coupling line 11 at the proximal end thereof. The second line section 102 includes a grounded-end/open-end coupling line 13 having an open proximal end and a grounded distal end, and a ground-end/open-end coupling line 14 having a grounded proximal end and an open distal end. The third line section 103 includes a balanced signal coupling line 15 having a balanced distal port connected to a balanced signal terminal T2, and a balanced coupling line 16 having a proximal balanced port connected to a balanced signal terminal T3. The proximal end of the balanced signal coupling line 15 is connected to the balanced signal coupling line 16 at the distal end thereof.

In the merchant balun 10, the first, second and third line sections 101, 102 and 103 are disposed adjacent to one another so that the signal transferring through one of the pair of coupling lines 11 and 12, for example, is transferred to a corresponding one of the adjacent pair of coupling lines 13 and 14 by induction coupling, and also to one of the pair of coupling lines 15 and 16 therethrough An unbalanced signal supplied through the unbalanced signal terminal T1 is transferred consecutively through the first line section 101, the second line section 102 and the third line section 103 to the pair of balanced signal terminals T2 and 73, and delivered therethrough as a pair of balanced signals each having an amplitude which is theoretically half the amplitude of the input unbalanced signal. Both the pair of balanced signals have an equal amplitude and a 180° phase difference therebetween.

In an alternative, a pair of balanced signals supplied through the pair of balanced signal terminals T2 and T3 are transferred consecutively through the third line section 103, the second line section 102 and the first line section 101 to the unbalanced signal terminal T1, and delivered therethrough as an output unbalanced signal That is, both the pair of input balanced signals are superimposed together and delivered as an unbalanced signal having an amplitude which is double the amplitude of the input balanced signals.

On the other hand, an unbalanced signal supplied through one of the pair of balanced signal terminals T2 and T3, for example, T2 is also transferred consecutively through the third, second and first line sections 103, 102 and 101 to the unbalanced signal terminal T1, and supplied therethrough as an output unbalanced signal. The output unbalanced signal has an amplitude which is half the amplitude of the input unbalanced signal. In this case, a part of the input unbalanced signal is delivered through the balanced signal terminal T3 as an unbalanced signal having an amplitude which is ¼ of the input unbalanced signal.

Figure 2:
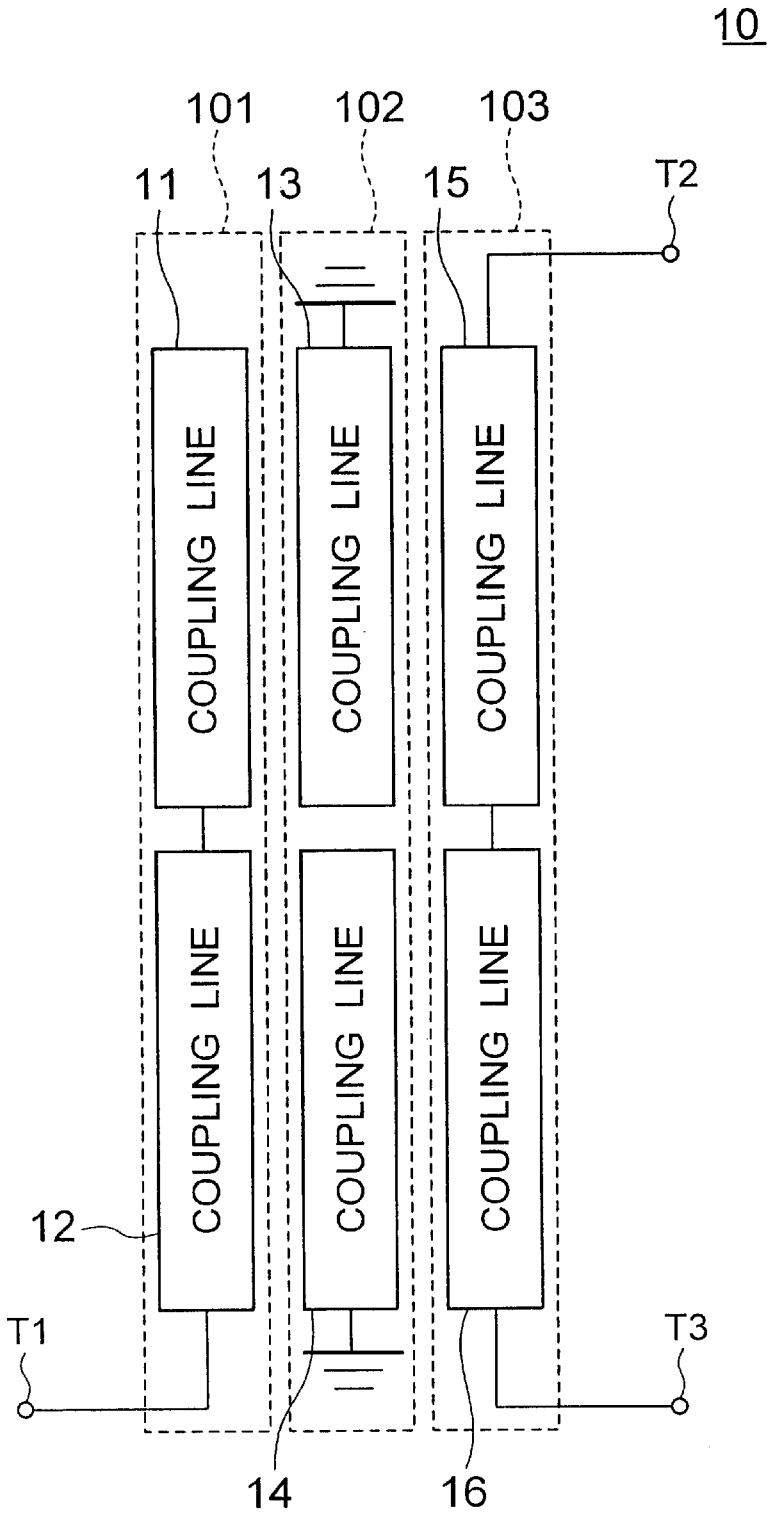
FIG. 2 PRIOR ART
FIGS. 2 is a block diagram of a known merchant balun.

FIGS. 3A to 3D show a prototype of the merchant balun of FIG. 2, wherein it is designed so that the matching impedances $Z_{L1}$ of the unbalanced signal terminal and the matching impedance $Z_{L2}$ of the balanced signal terminals are 50Ω and 25Ω, respectively, at a frequency of 2.2 GHz.

Figure 3A:
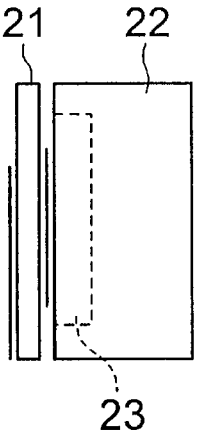
FIG. 3A PRIOR ART
FIG. 3A is a side view of a prototype 180° phase shift circuit for the second embodiment.
Figure 3B:
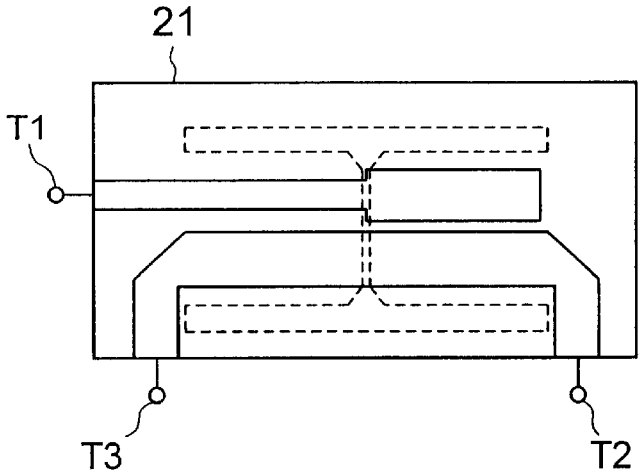
FIG. 3B PRIOR ART
FIG. 3B is a front view thereof.

As shown in FIG. 3A, the 180° phase shift circuit includes a dielectric substrate 21 having a dielectric constant of 2.2 and a thickness of 0.8 mm, and a housing 22 disposed at the rear surface of the dielectric substrate 21 and having a 1.2-mm-thick cavity 23. The dielectric substrate 21 mounts thereon a patterned circuitry having the configuration of FIG. 2 and including the unbalanced terminal T1 and the balanced terminals T2 and T3.

Figure 3C:
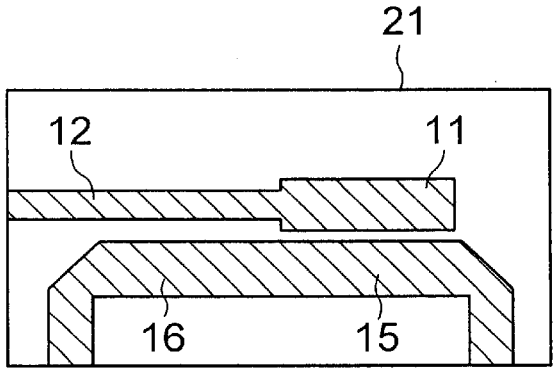
FIG. 3C PRIOR ART
FIG. 3C is a top plan view of the dielectric substrate.
Figure 3D:
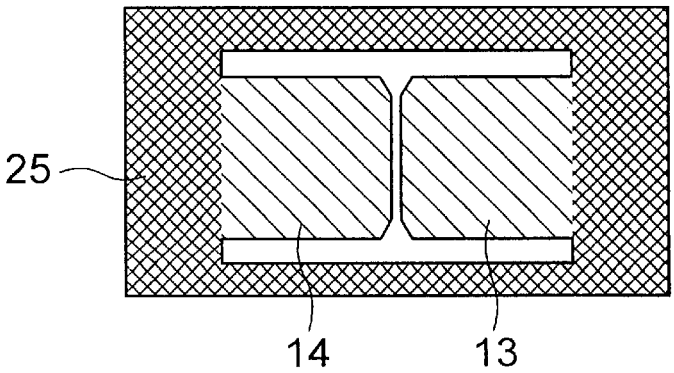
FIG. 3D PRIOR ART
FIG. 3D is a bottom view of the dielectric substrate.

Referring to FIG. 3C, the front surface of the dielectric substrate 21 mounts thereon the open-end coupling line 11 having a length of 25.5 mm and a width of 3.5 mm, the unbalanced signal coupling line 12 extending therefrom and having a length of 27 mm and a width of 2.5 mm, the balanced signal coupling lines 15 and 16 each having a length of 27 mm and a width of 5.5 mm Referring to FIG. 3D, the rear surface of the dielectric substrate 21 mounts thereon grounded end/open end coupling lines 13 and 14. A contact region 25 is disposed around the coupling lines 13 and 14 wherein the dielectric substrate 21 and the housing 22 are in contact with each other.

Figure 4A:
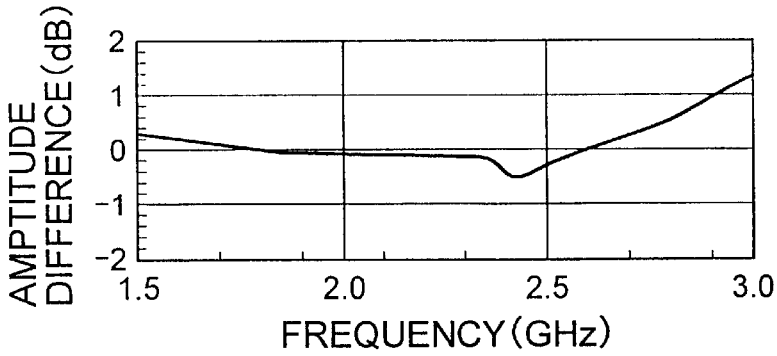
FIG. 4A PRIOR ART
FIGS. 4A to 4D are graphs showing the results of measurements in amplitude-difference, phase-difference, transmission loss and isolation characteristics, respectively, of the prototype 180° phase shift circuit of FIGS. 3A to 3D.
Figure 4B:
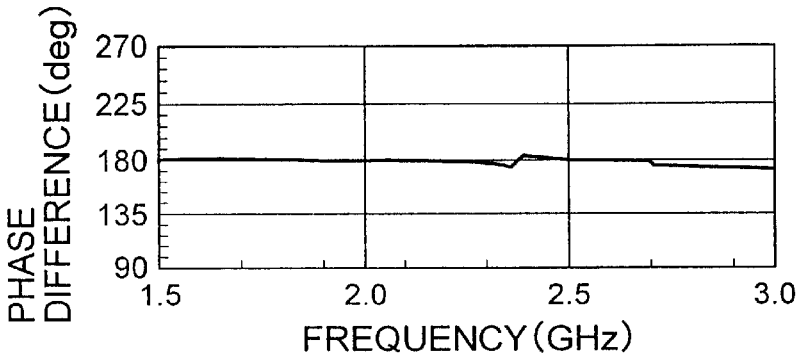
FIG. 4B PRIOR ART
Figure 4C:
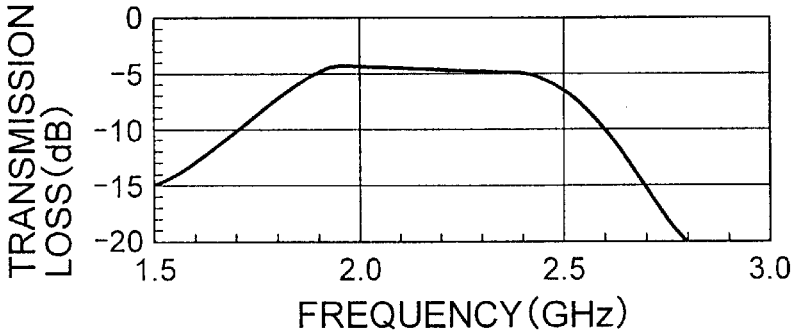
FIG. 4C PRIOR ART
Figure 4D:
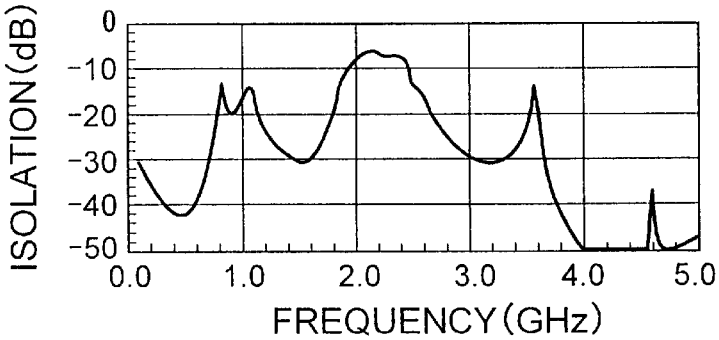
FIG. 4D PRIOR ART

FIGS. 4A to 4D show characteristics of the prototype merchant balun, obtained by inputting an unbalanced signal through the unbalanced signal terminal T1 to obtain a pair of balanced signals through the balanced signal terminals T2 and T3. FIG. 4A shows an amplitude-difference characteristic wherein the difference between the amplitudes of the pair of balanced signals is plotted against the frequency of the input signal, FIG. 4B shows a phase-difference characteristic wherein the phase difference between the pair of balanced signals is plotted against the frequency, and FIG. 4C shows a transmission loss wherein the ratio of the output power of one of the balanced signals to the input power of the unbalanced signal is plotted in terms of decibel against the frequency. FIG. 4D shows an isolation characteristic, in the case of an unbalanced signal being input through one of the balanced signal terminals to output an unbalanced signal through the other of the balanced signal terminals, shown in terms of the ratio (dB) of the amplitude of the input unbalanced signal to the amplitude of the output unbalanced signal.

As shown in FIGS. 4A to 4C, in the frequency range between 2.0 GHz and 2.4 GHz, the amplitude difference is below 0.2 dB, the phase difference is 180±5 degrees, and the transmission loss deviates only 0.5 dB from −3.0 dB which corresponds to ½ of the amplitude ratio between the output balanced signal and the input unbalanced signal. These characteristics are satisfactory for the 180° phase shift circuit In FIG. 4D, the isolation characteristic shows −6 dB which corresponds to ¼ of the amplitude ratio.

Now, the present invention is more specifically described with reference to accompanying drawings, wherein similar constituent elements are designated by similar reference numerals.

Figure 5:
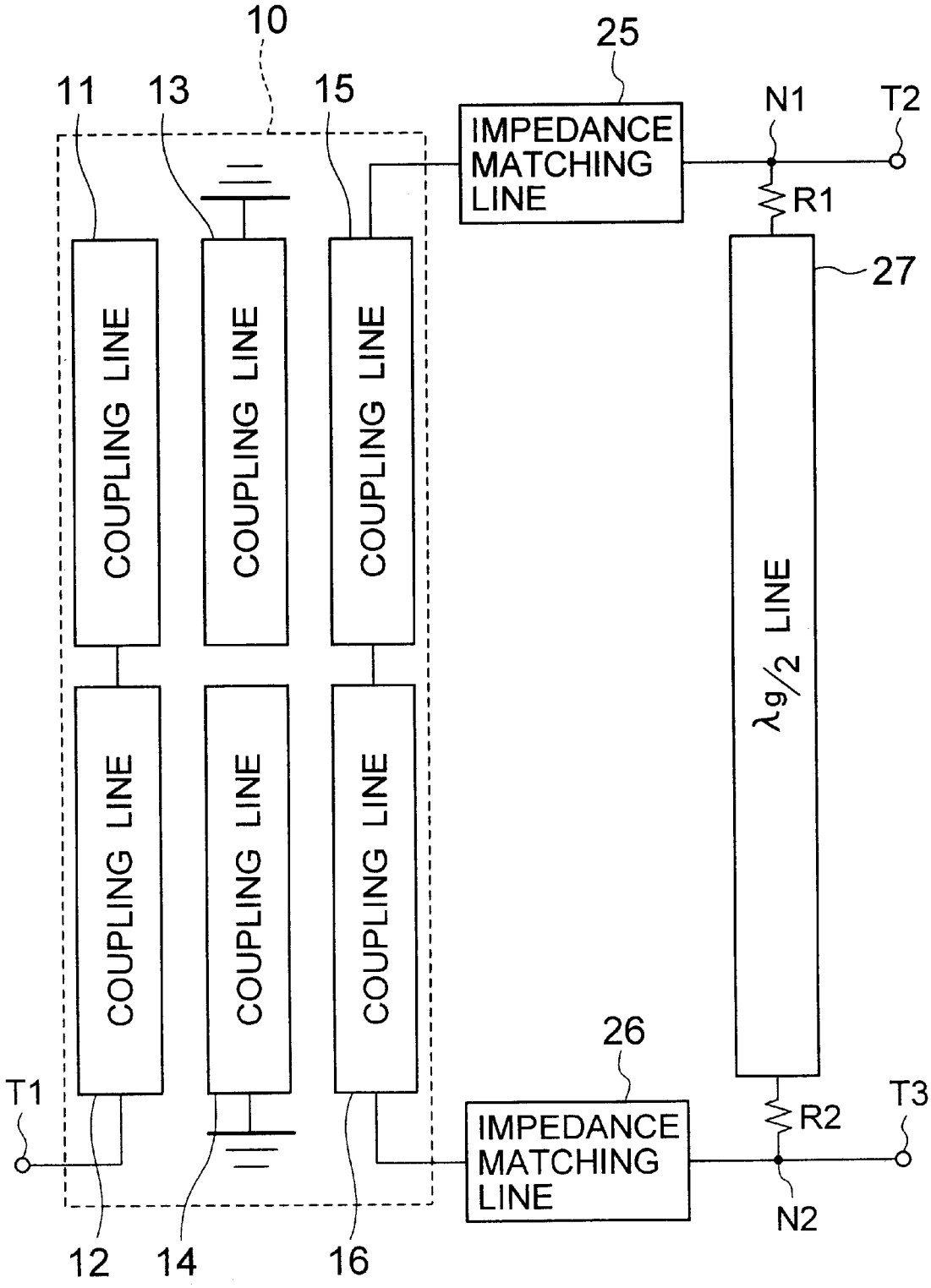
FIG. 5 is a block diagram of a 180° phase shift circuit according to a first embodiment of the present invention.

Referring to FIG. 5, a 180° phase shift circuit according to a first embodiment of the present invention includes a merchant balun 10, a pair of impedance matching lines 25 and 26, a λg/2 (half-wavelength) distributed parameter line 27 and a pair of absorbing resistors R1 and R2.

The merchant balun 10 includes an unbalanced port connected to an unbalanced signal terminal T1, a first balanced port connected to a first balanced signal terminal T2 via the impedance matching line 25, and a second balanced port connected to a second balanced signal terminal T3 a via the impedance matching line 26. A branch including the absorbing resistor R1, the λg/2 distributed parameter line 27 and the absorbing resistor R2 connected in series in this order is connected between a node N1 located at a specified distance from the end of the impedance matching line 25 on a line connecting the impedance matching line 25 to the first balanced signal terminal T2 and a node N2 located at a specified distance from the impedance matching line 26 on a line connecting the impedance matching line 26 to the second balanced signal terminal 26.

The λg/2 distributed parameter line 27 has a specific characteristic impedance and has a line length equal to half the wavelength of the input signal. The impedance matching lines 25 and 26 have a matching impedance equal to the matching impedance $Z_{L2}$ of the balanced signal terminals T2 and T3, and have an equal electrical length.

In the 180° phase shift circuit of FIG. 5, the characteristics of the merchant balun 10 are not affected by the impedance matching lines 25 and 26, the λg/2 distributed parameter line 27 and the pair of absorbing resistors R1 and R2, as detailed below.

Figure 6:
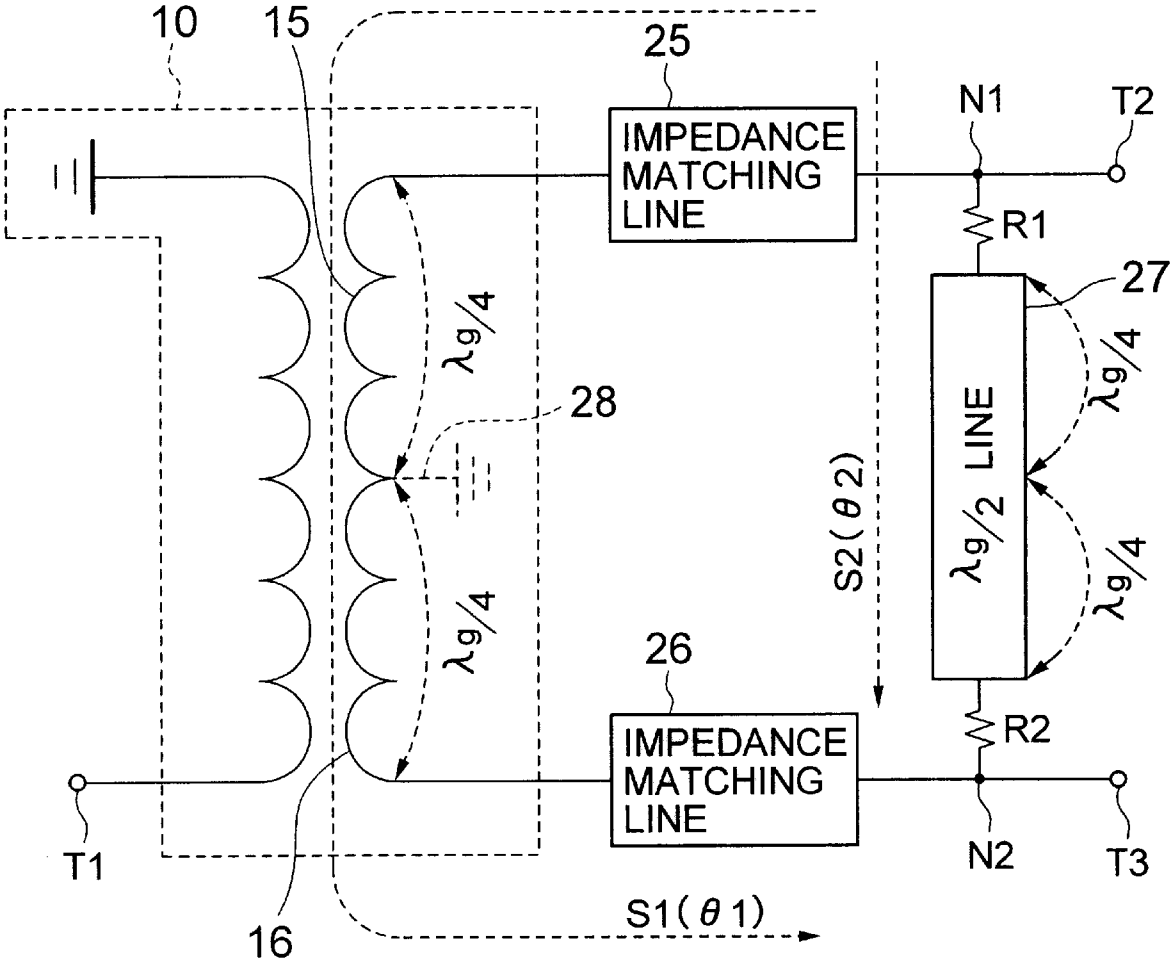
FIG. 6 is an equivalent circuit diagram for the 180° phase shift circuit of FIG. 5

Referring to FIG. 6 showing an equivalent circuit diagram for FIG. 5, the 180° phase shift circuit receives an unbalanced signal through the unbalanced signal terminal T1, and delivers a pair of balanced signals through the balanced signal terminals T2 and T3 to which the output stage of the 180° phase shift circuit is impedance-matched. The merchant balun 10 has an imaginary ground at the node 28 connecting together the balanced signal coupling lines 15 and 16 each of which has an electrical length equal to ¼ of the wavelength of the input signal from each balanced port, because both the balanced signal components are canceled by each other to assume zero at the node 28.

The impedance matching lines 25 and 26 are impedance-matched with the first and second balanced ports, respectively, and have an equal electrical length. Thus, the balanced signals transferred on the nodes N1 and N2 have an equal amplitude and a phase difference of 180° therebetween.

The λg/2 distributed parameter line 27 can be regarded as a λg/4 line as viewed from the nodes N1 and N2, wherein the receiving end of the λg/4 distributed parameter line is grounded at an imaginary ground at the point located ¼ wavelength from the nodes N1 and N2. As a result, a high impedance appears between the nodes N1 and N2, whereby the balanced signals transferring through the nodes N1 and N2 are not affected by the λg/2 distributed parameter line 27. Thus, the 180° phase shift circuit has excellent 180° phase shift characteristics.

The 180° phase shift circuit has also an excellent isolation characteristic as detailed below. In the 180° phase shift circuit, it is assumed that an external stage succeeding the balanced signal terminal T2 has an impedance-mismatching to generate a reflected wave. The reflected wave returns to the 180° phase shift circuit in the opposite direction through the balanced signal terminal T2 and is separated at the node N1 to form a first leakage signal S1 and a second leakage signal S2.

The first leakage signal S1 transfers through the node N1, impedance matching line 25, the merchant balun 10 and the impedance matching lie 26 to the node N2 in the recited order, as shown by the dotted line in FIG. 6. The first leakage signal S1 reduces the amplitude thereof by ¼ (i.e., −6 dB) and has a phase delay θ1 of 2n×π radians at the node N2 with respect to the first leakage signal S1 on the node N1, where "n" is an integer. The first leakage signal S1 reduces the amplitude thereof by ¼ upon passing through the merchant balun 10, whereas the leakage signal S1 does not reduces the amplitude thereof upon passing though the impedance matching lines 25 and 26. The leakage signal S1 is subjected to a phase delay θ1 of π radians or ½ wavelength upon passing the merchant balun 10. The length of the impedance matching lines 25 and 26 is adjusted so that the first leakage signal S1 passing through the impedance matching lines 25 and 26 is subjected to a phase delay θ1 of (2n−1)×π upon the passing, whereby the first leakage signal S1 has a total phase delay θ1 of 2n×π.

The second leakage signal S2 transfers through the node N1, the first absorbing resistor R1, the λg/2 distributed parameter line 27 and the second absorbing resistor R2 to the node N2 in the recited order, as shown by a dotted line in FIG. 6 The second leakage signal S2 reduces the amplitude thereof by ¼ (i.e., −6 dB) and a phase delay θ2 of π radians at the node N2 with respect to the second leakage signal S2 on the node N1, where "n" is an integer The second leakage signal S2 is subjected to a phase delay θ2 of π radians or half wavelength upon passing the λg/2 distributed parameter line 27, whereas the phase delay θ2 of the second leakage signal S2 is not affected upon passing through the absorbing resistors R1 and R2. The resistance of the absorbing resistors R1 and R2 is adjusted so that R1=R2=$Z_{L2}$×3/2 where $Z_{L2}$ is a matching impedance of the balanced signal terminals T2 and T3. The second leakage signal S2 reduces the amplitude thereof by ¼ upon passing through the absorbing resistors R1 and R2, whereas the second leakage signal S2 dose not reduce the amplitude thereof upon passing through the λg/2 distributed parameter line 27.

Thus, the first leakage signal S1 and the second leakage signal S2 have an equal amplitude and has a phase difference of (2n−1) π therebetween, i.e., both the leakage signals S1 and S2 are opposite in phase with an equal amplitude, whereby the leakage signals S1 and S2 cancel each other to assume zero on the node N2.

Figure 7A:
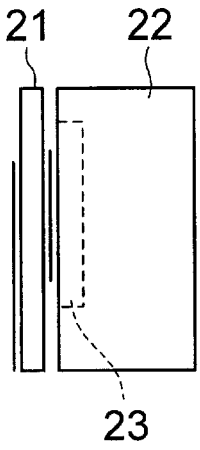
FIGS. 7A to 7D show a prototype 180° phase shift circuit for the first embodiment, similarly to FIGS. 3A to 3D, respectively.
Figure 7B:
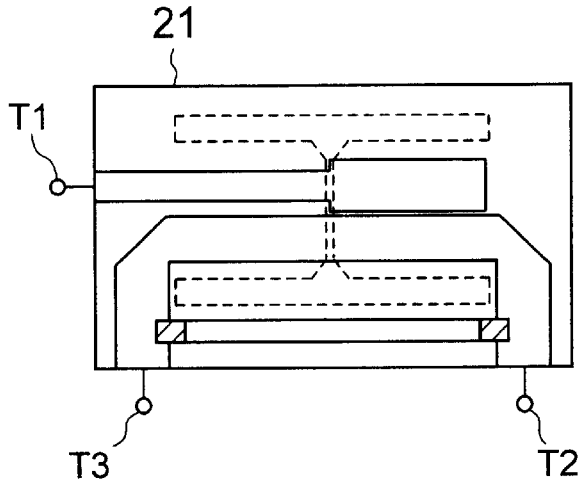

Referring to FIGS. 7A and 7B, a prototype 180° phase shift circuit of the first embodiment is designed so that the matching impedance $Z_{L1}$ of the unbalanced signal terminal is 50Ω and the matching impedance of the balanced signal terminals is 25Ω at the input frequency of 2.2 GHz.

The prototype 180° phase shift circuit, as shown in FIG. 4A, includes a dielectric substrate 21 having a dielectric constant of 2.2 and a thickness of 0.8 mm, and a housing 22 for supporting the dielectric substrate 21 at the rear surface thereof The housing 22 has a 1.2-mm-deep cavity 23, which prevents the rear surface of the dielectric substrate 21 from a direct contact with another clement.

The dielectric substrate 21, as shown in FIG. 4A, mounts thereon a circuit pattern including the unbalanced signal terminal T1, and the pair of balanced signal terminals T2 and T3. The dielectric substrate 21 is made of Teflon, and the circuit pattern includes a 8-μm-thick Cu film and a 5-μm-thick Au film.

Figure 7C:
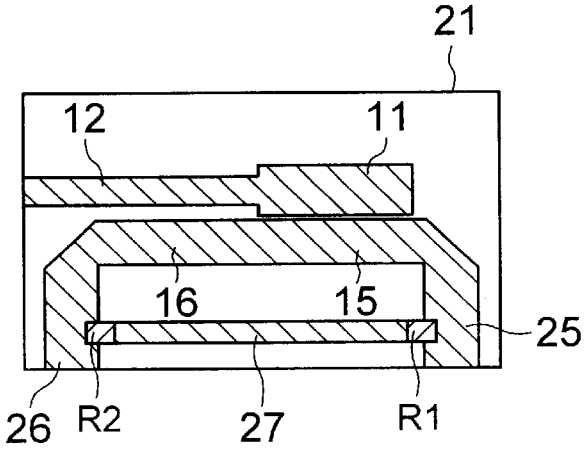

Referring to FIG. 7C, the circuit pattern formed on the top surface of the dielectric substrate 21 includes an open-end coupling line 11 which is 25.5 mm long and 3.5 mm wide and has an open distal end, an unbalanced signal coupling line 12 which is 27 mm long and 25 mm wide and extends from the proximal end of the coupling line 11, a pair of balanced signal coupling lines 15 and 16 each of which is 27 mm long and 5.5 mm wide, a pair of impedance matching lines 25 and 26 each of which is 15 mm long and 5.5 mm wide, a λg/2 distributed parameter line 27 which is 52 mm long and 1 mm wide, and a pair of absorbing resistors R1 and R2 each connected between the λg/2 distributed parameter line 27 and the corresponding impedance matching line 25 or 26 and having a resistance of 37.5Ω.

Figure 7D:
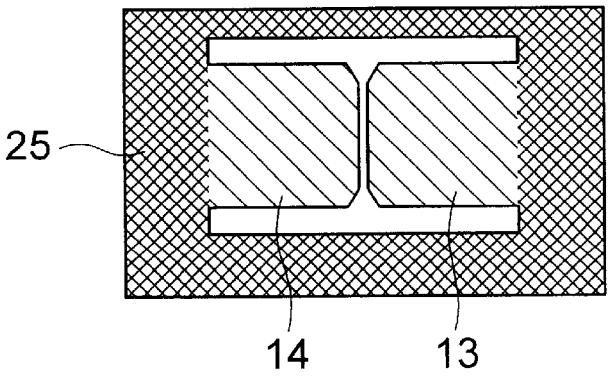

Referring to FIG. 7D, the rear surface of the dielectric substrate 21 mounts thereon a coupling line 13 having an open proximal end and a grounded distal end which is in contact with the outer periphery 25 of the housing 22, and a coupling line 14 having an open distal end and a grounded proximal end which is in contact with the outer periphery 25 of the housing 21. The coupling line 13 is induction-coupled with the coupling lines 11 and 15 formed on the front surface of the dielectric substrate 21, whereas the coupling line 14 is induction-coupled with the coupling lines 12 and 16 formed on the front surface of the dielectric substrate 21.

Referring to FIGS. 8A to 8D, there arc shown characteristics of the prototype 180° phase shift circuit similarly to FIGS. 4A to 4D, respectively.

Figure 8A:
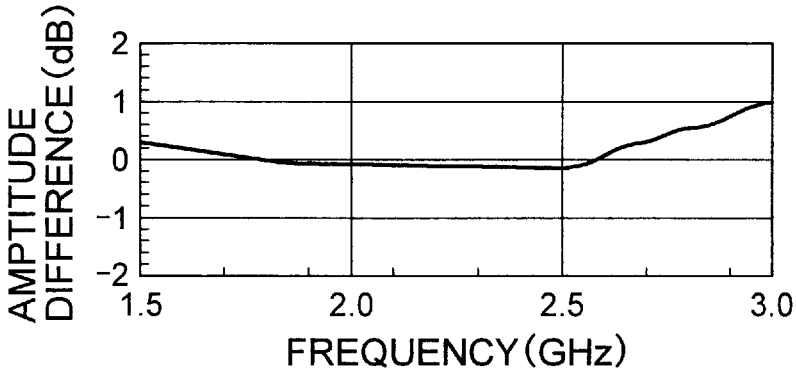
FIGS. 8A to 8D are graphs showing the results of measurements in amplitude-difference, phase-difference, transmission loss and isolation characteristics, respectively, of the prototype 180° phase shift circuit of FIGS. 7A to 7D.
Figure 8B:
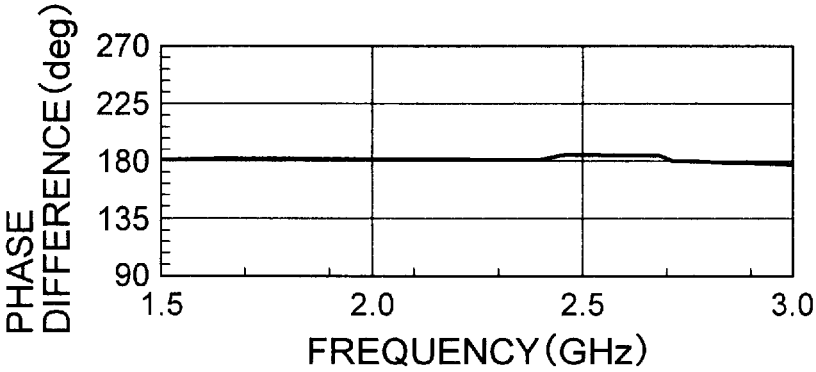
Figure 8C:
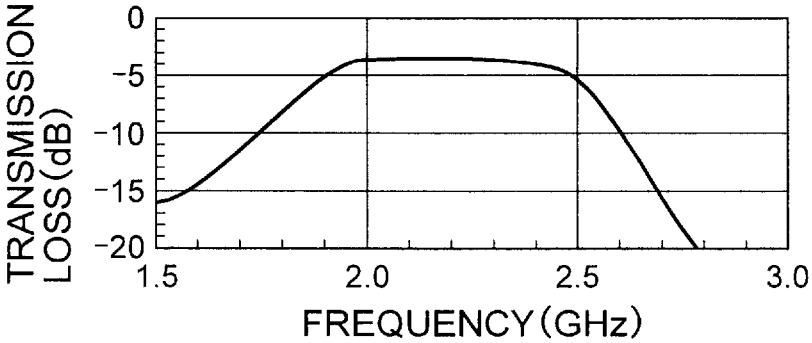
Figure 8D:
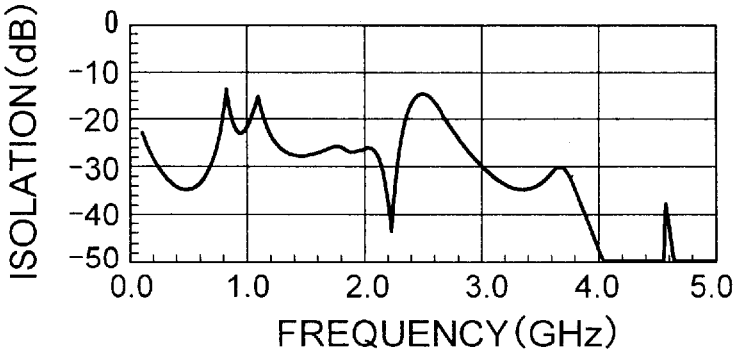

In FIGS. 8A to 8C, the prototype 180° phase shift circuit has an amplitude-difference characteristic wherein both the output balanced signal have an amplitude difference therebetween which is less than 0.2 dB in the frequency range between 2.0 and 2.4 GHz, a phase difference characteristic wherein both the output balanced signals have a phase difference therebetween which is 180±5 degrees, and a transmission loss which is deviated by less than 0.5 dB from −3.0 dB which corresponds to ½. In FIG. 8D, the minimum isolation in the frequency range between 2.0 and 2.4 GEz is −25 dB, and the minimum isolation is −15 dB in the entire frequency range measured therefor. All these characteristic curves exhibit that the prototype 180° phase shift circuit has excellent phase shift and isolation characteristics.

In the above embodiment, the λg/2 distribution parameter line 27 and the absorbing resistors R1 and R2 do not affect the balanced signals, and cancel the leakage signals by themselves, whereby the 180° phase shift circuit has excellent phase shift characteristics and improved isolation characteristic.

Figure 9:
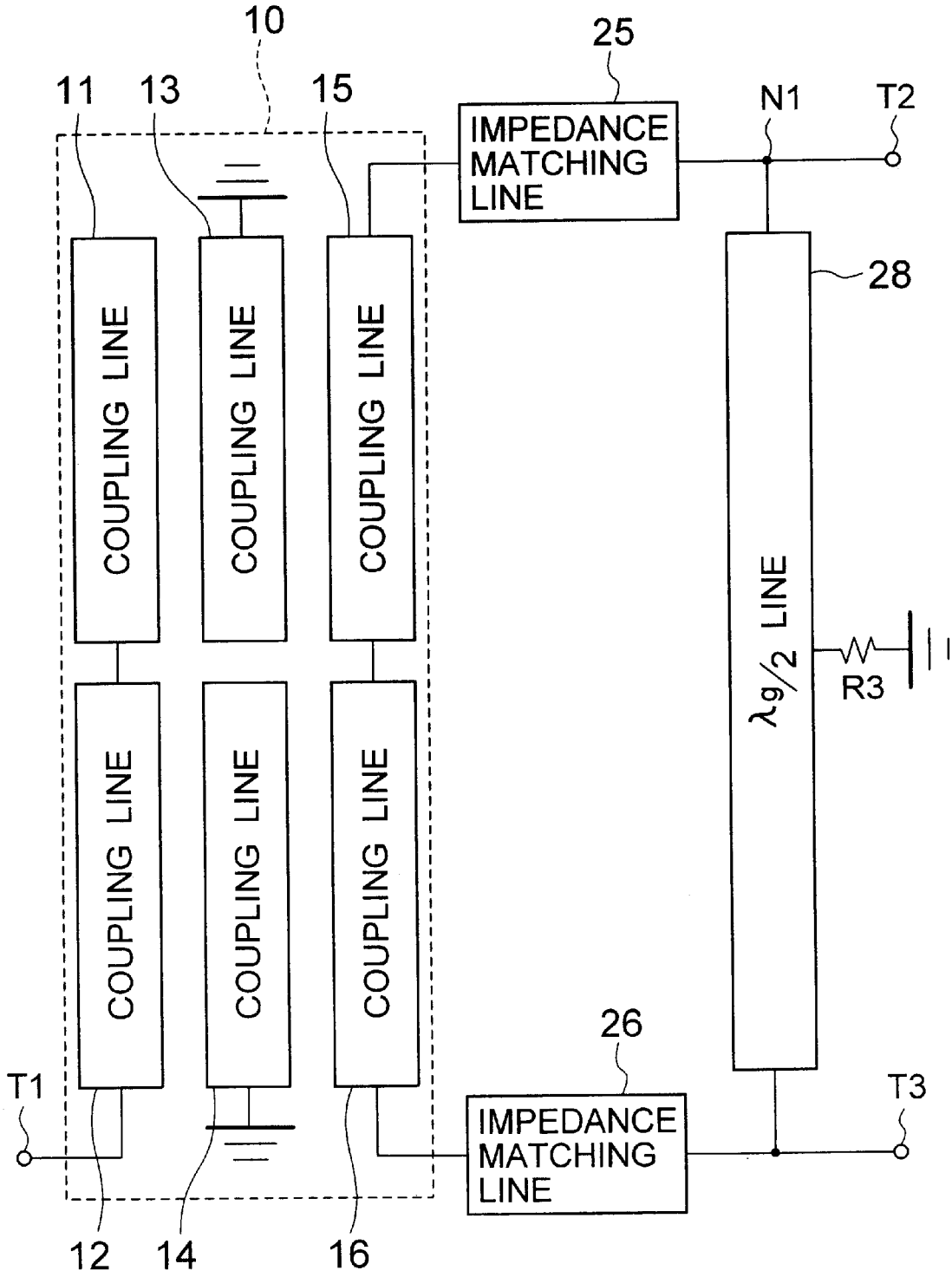
FIG. 9 is a block diagram of a 180° phase shift circuit according to a second embodiment of the present invention.

Referring to FIG. 9, a 180° phase shift circuit according to a second embodiment of the present invention is similar to the first embodiment except that an absorbing resister R3 is connected between the central point of a λg/2 distribution parameter line 28 and the ground in the second embodiment, instead of the absorbing resistors R1 and R2 connected to both ends of the λg/2 distribution parameter line 27 in the first embodiment.

Figure 10:
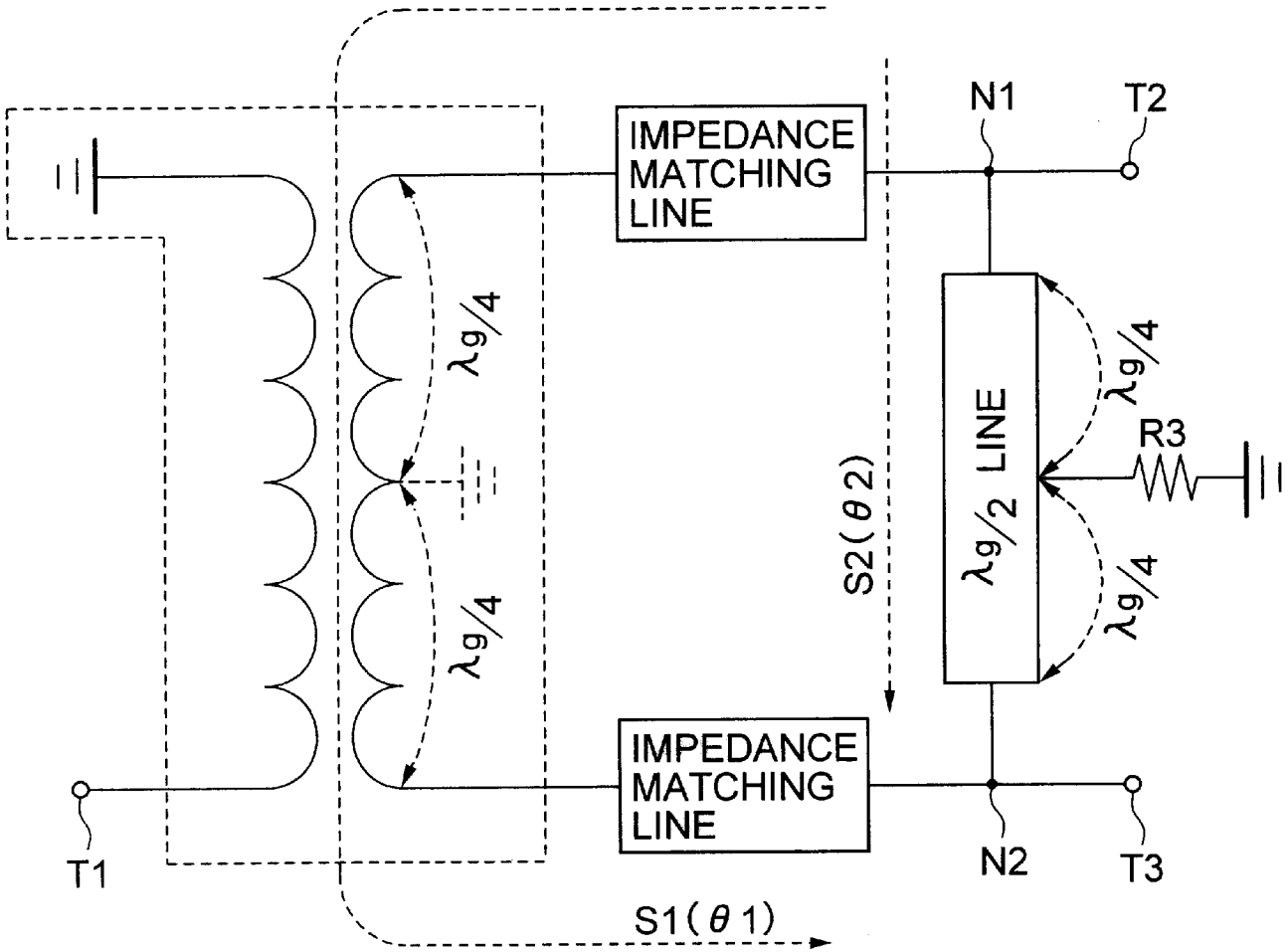
FIG. 10 is an equivalent circuit diagram for the 180° phase shift circuit of FIG. 9.

Referring to FIG. 10 showing the equivalent circuit diagram for FIG. 9, the absorbing resistor R3 connected between the central point of the λg/2 distributed parameter line 28 and the ground is equal to $Z_{L2}/3$ wherein $Z_{L2}$ is the matching impedance of the balanced signal terminals T2 and T3. The leakage signal S1 and the leakage signal S2 separated on the node N1 cancel each other on the node N2, as in the case of the first embodiment.

Figure 11A:
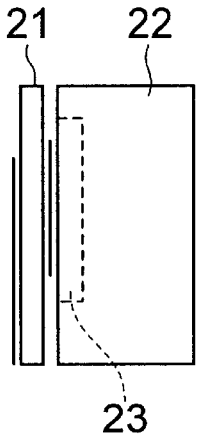
FIGS. 11A to 11D show a prototype 180° phase shift circuit for the second embodiment, similarly to FIGS. 3A to 3D, respectively.
Figure 11B:
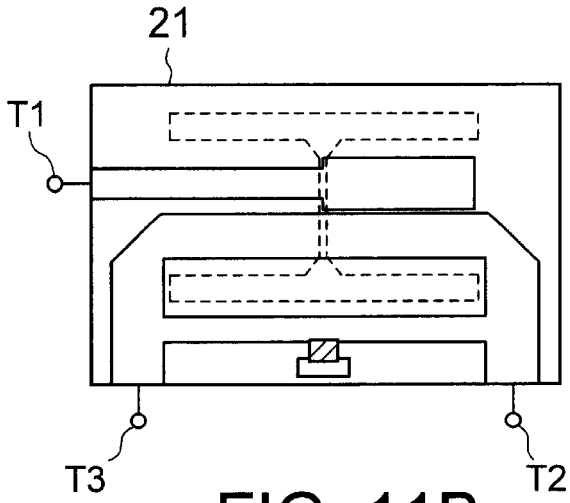
Figure 11C:
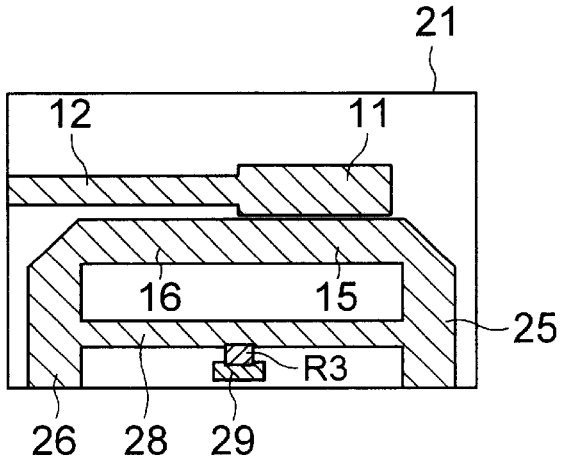
Figure 11D:
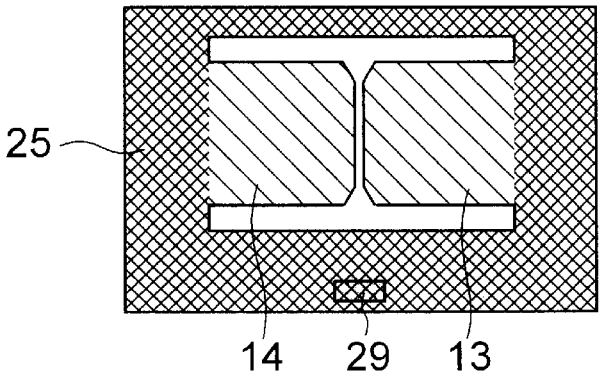

Referring to FIGS. 11A to 11D, a prototype 180° phase shift circuit of the second embodiment has a λg/2 distributed parameter line 28 which is 52 mm long and 1 mm wide, a through-hole 29 filled with a via plug for connecting a first terminal of the absorbing resistor R3 to the ground, the absorbing resistor R3 having a second terminal connected to the center of the λg/2 distributed parameter line 28. The absorbing resistor R3 has a resistance of 8.3Ω. In FIG. 11D, the via plug is in contact with the outer periphery of the housing 21 for grounding.

In the frequency range of the input signal, the phase shift characteristics and the isolation characteristic of the 180° phase shift circuit of the present embodiment are superior to the conventional phase shift circuit. In addition, since the second embodiment has a single resistor R3, the second embodiment affords the advantage of reduction of the number of elements compared to the first embodiment.

Figure 12:
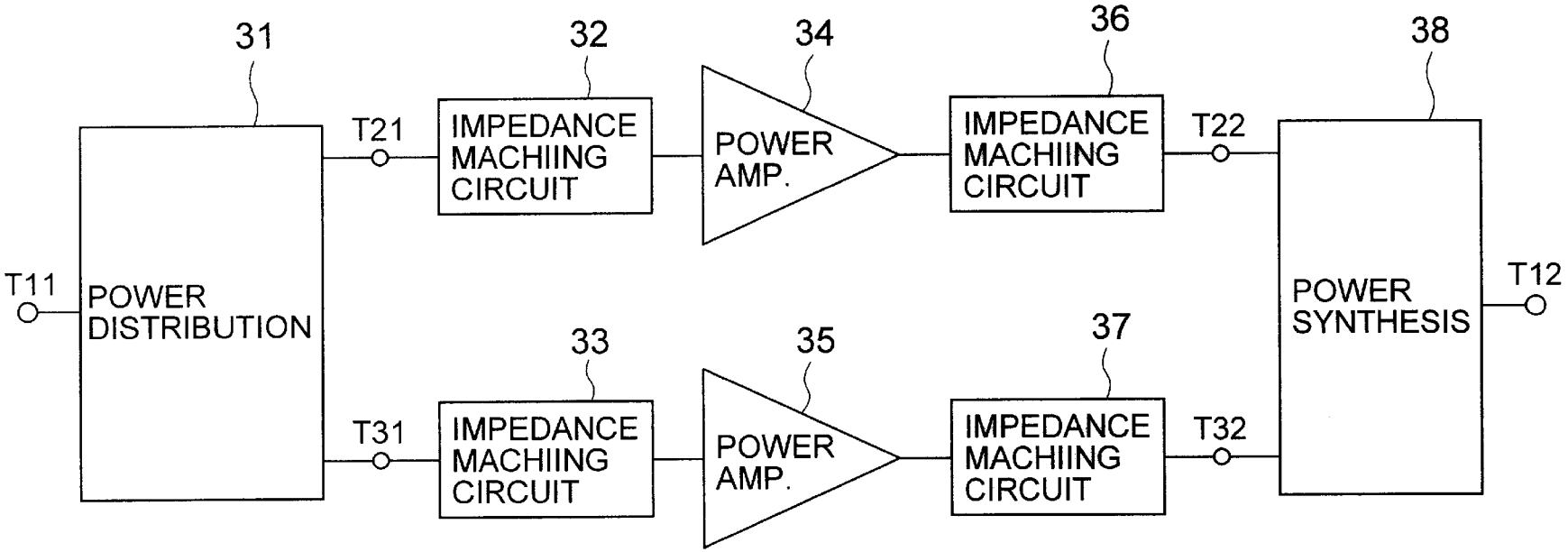
FIG. 12 is a block diagram of a power amplifying system using the 180° phase shift circuit of the present invention.

Referring to FIG. 12, a power amplifying system includes a power distribution section 31 and a power synthesis section 32 each implemented by a 180° phase shift circuit according to one of the embodiments of the present invention. The power amplifying system includes the power distribution section 31 having an unbalanced signal input terminal T11 and a pair of balanced signal output terminals T21 and T31, a pair of input impedance-matching circuits 32 and 33 for transmitting a pair of balanced signals, a pair of power amplifiers 34 and 35 for amplifying the balanced signals supplied through the input impedance-matching circuits 32 and 33, a pair of output impedance-matching circuits 36 and 37 for transferring the amplified balanced signals, and the power synthesis section 38 having a pair of balanced signal input terminals T22 and T32 and an unbalanced signal output terminal T12.

In the power amplifying system of FIG. 12, the input and output terminals of each power amplifier 34 or 35 are impedance-matched by the impedance-matching circuits 32 and 36 or 33 and 37 with the balanced signal terminals T21 and T22 or T31 and T32 of the 180° phase shift circuit 31 or 38. If impedance-mismatching occurs in the input impedance-matching circuit 32, for example, the reflected wave generated in the input impedance-matching circuit 32 cannot enter the input impedance-matching circuit 33 via the power distribution section 31 due to the excellent isolation characteristic of the power distribution section 31. Thus, degradation of the amplifying characteristics of the power amplifying system can be suppressed.

Since the above embodiments are described only for examples, the present invention is not limited to the above embodiments and various modifications or alterations can be easily made therefrom by those skilled in the art without departing from the scope of the present invention.

What is claimed is:

1. A 180° phase shift circuit comprising:

first through third signal terminals;

a balun including first and second balanced ports for receiving/delivering respective balanced signals and a third port for delivering/receiving an unbalanced signal;

a first impedance matching line having an impedance matched with said first balanced port and connected between said first balanced port and said first signal terminal;

a second impedance matching line having an impedance matched with said second balanced port and connected between said second balanced port and said second signal terminal; and a serial branch including first and second resistors and a λg/2 distribution parameter line connected between said first resistor and said second resistor, said serial branch being connected between a first node connecting together said first impedance matching line and said first signal terminal and a second node connecting together said second impedance matching line and said second signal terminal, wherein the length of the impedance matching lines is such that a first leakage signal passing through the impedance matching lines is subjected to a phase delay $\theta_1$ of $(2n-1)\times\pi$, so that the first leakage signal generated by a reflected wave and passing through the impedance matching lines and the balun cancels a second leakage signal generated by the reflected wave and passing through the λg/2 distribution parameter line.

2. The 180° phase shift circuit as defined in claim 1, wherein each of said first and second resistors has a resistance which is substantially equal to 3/2 of a characteristic impedance of said first and second impedance matching lines.

3. A 180° phase shift circuit comprising:

first through third signal terminals;

a balun including first and second balanced ports for receiving/delivering respective balanced signals and a third port for delivering/receiving an unbalanced signal;

a first impedance matching line having an impedance matched with said first balanced port and connected between said first balanced port and said first signal terminal;

a second impedance matching line having an impedance matched with said second balanced port and connected between said second balanced port and said second signal terminal;

a λg/2 distribution parameter line connected between a first node connecting together said first impedance matching line and said first signal terminal and a second node connecting together said second impedance matching line and said second signal terminal; and a resistor connected between a central point of said λg/2 distribution parameter line and ground;

wherein the length of the impedance matching lines is such that a first leakage signal passing through the impedance matching lines is subjected to a phase delay $\theta_1$ of $(2n-1)\times\pi$, so that the first leakage signal generated by a reflected wave and passing through the impedance matching lines and the balun cancels a second leakage signal generated by the reflected wave and passing through the λg/2 distribution parameter line.

4. The 180° phase shift circuit as defined in claim 3, wherein said resistor has a resistance which is substantially equal to 1/3 of a characteristic impedance of said first and second impedance matching lines.

5. A power amplifying system comprising a first 180° phase shift circuit having an unbalanced signal terminal for receiving an input unbalanced signal and a pair of balanced signal terminals, a pair of power amplifiers, a second 180° phase shift circuit having a pair of balanced signal terminals and an unbalanced signal terminal for outputting an amplified unbalanced signal, a pair of input impedance matching circuits each connected between one of said pair of balanced signal terminals of said first 180° phase shift circuit and an input of one of said pair of power amplifiers, and a pair of output impedance matching circuits each connected between an output of one of said pair of power amplifiers and one of said pair of balanced signal terminals of said second 180° phase shift circuit, each of said first and second 180° phase shift circuits including:

a balun including an unbalanced port connected to said unbalanced signal terminal, a pair of balanced ports each connected to one of said pair of balanced signal terminals via a corresponding impedance matching line that is matched to the corresponding port, and a serial branch including first and second resistors and a λg/2 distribution parameter line connected between said first resistor and a second resistor, said serial branch being connected between a first node connecting together corresponding said impedance matching line and one of said pair of balanced signal terminals and a second node connecting together corresponding said impedance matching line and the other of said pair of balanced signal terminals, wherein the length of the impedance matching lines is such that a first leakage signal passing through the impedance matching lines is subjected to a phase delay $\theta_1$ of $(2n-1)\times\pi$, so that the first leakage signal generated by a reflected wave and passing through the impedance matching lines and the balun cancels a second leakage signal generated by the reflected wave and passing through the λg/2 distribution parameter line.

6. A power amplifying system comprising a first 180° phase shift circuit having an unbalanced signal terminal for receiving an input unbalanced signal and a pair of balanced signal terminals, a pair of power amplifiers, a second 180° phase shift circuit having a pair of balanced signal terminals and an unbalanced signal terminal for outputting an amplified unbalanced signal, a pair of input impedance matching circuits each connected between one of said pair of balanced signal terminals of said first 180° phase shift circuit and an input of one of said pair of power amplifiers, and a pair of output impedance matching circuits each connected between an output of one of said pair of power amplifiers and one of said pair of balanced signal terminals of said second 180° phase shift circuit, each of said first and second 180° phase shift circuits including:

a balun including an unbalanced port connected to said unbalanced signal terminal, a pair of balanced ports each connected to one of said pair of balanced signal terminals via a corresponding impedance matching line that is matched to the corresponding port, a λg/2 distribution parameter line connected between a first node connecting together corresponding said impedance matching line and one of said pair of balanced signal terminals and a second node connecting together corresponding said impedance matching line and the other of said pair of balanced signal terminals, and a resistor connected between a central point of said λg/2 distribution parameter line and ground, wherein the length of the impedance matching lines is such that a first leakage signal passing through the impedance matching lines is subjected to a phase delay $\theta_1$ of $(2n-1)\times\pi$, so that the first leakage signal generated by a reflected wave and passing through the impedance matching lines and the balun cancels a second leakage signal generated by the reflected wave and passing through the λg/2 distribution parameter line.

* * * * *